US006036847A

United States Patent [19]

Ziebarth et al.

[11] Patent Number: 6,036,847

[45] Date of Patent: Mar. 14, 2000

[54] COMPOSITIONS FOR USE IN CATALYTIC CRACKING TO MAKE REDUCED SULFUR CONTENT GASOLINE

[75] Inventors: Michael S. Ziebarth, Columbia, Md.; Michael D. Amiridis, Columbia, S.C.; Robert H. Harding, Ellicott City; Richard F. Wormsbecher, Highland, both of Md.

[73] Assignee: W. R. Grace & Co.-Conn., New York, N.Y.

[21] Appl. No.: 08/624,727

[22] Filed: Mar. 26, 1996

[51] Int. Cl.[7] ..... C10G 11/02

[52] U.S. Cl. ..... 208/113; 208/120; 208/153

[58] Field of Search ..... 208/120, 113, 208/153

[56] References Cited

U.S. PATENT DOCUMENTS

| | | | |
|---|---|---|---|
| 2,618,586 | 11/1952 | Hendel | 196/30 |
| 3,016,346 | 1/1962 | O'Hara | 208/216 |
| 3,401,125 | 9/1968 | Jaffe | 252/439 |
| 3,696,025 | 10/1972 | Chessmore et al. | 208/113 |
| 4,093,560 | 6/1978 | Kerr et al. | 252/455 |
| 4,107,088 | 8/1978 | Elliott, Jr. | 252/455 |
| 4,111,846 | 9/1978 | Elliott, Jr. | 252/455 |
| 4,219,447 | 8/1980 | Wheelock | 252/466 |
| 4,299,733 | 11/1981 | Tu | 252/455 |
| 4,369,108 | 1/1983 | Bertolacini | 208/120 |
| 4,421,637 | 12/1983 | Grenoble et al. | 208/120 |
| 4,432,890 | 2/1984 | Beck et al. | 502/62 |
| 4,451,355 | 5/1984 | Mitchell et al. | 208/113 |
| 4,465,790 | 8/1984 | Quayle | 502/309 |
| 4,549,958 | 10/1985 | Beck et al. | 208/253 |
| 4,552,647 | 11/1985 | Hettinger et al. | 208/120 |
| 4,704,375 | 11/1987 | Martinez et al. | 502/64 |
| 4,705,770 | 11/1987 | Cullo et al. | 502/242 |
| 4,816,135 | 3/1989 | Martinez et al. | 208/120 |
| 4,973,399 | 11/1990 | Green et al. . | |
| 4,975,256 | 12/1990 | Hegedus et al. | 423/239 |
| 5,015,453 | 5/1991 | Chapman | 423/306 |
| 5,162,283 | 11/1992 | Moini et al. . | |
| 5,376,608 | 12/1994 | Wormsbecher et al. . | |
| 5,453,263 | 9/1995 | Blosser et al. | 423/713 |

FOREIGN PATENT DOCUMENTS

| | | |
|---|---|---|
| 0318808 | 6/1989 | European Pat. Off. . |
| 0435539 | 7/1991 | European Pat. Off. . |
| 0554968 | 8/1993 | European Pat. Off. . |

*Primary Examiner*—Helane Myers
*Attorney, Agent, or Firm*—Charles A. Cross

[57] ABSTRACT

Compositions which contain a titania component have been found which provide reduction of sulfar levels in the gasoline resulting from FCC processes (and other cracking processes conducted in the absence of added hydrogen) without the need for feedstock pretreatments nor added hydrogen. The compositions preferably also contain an alumina supported Lewis acid component. These compositions are preferably used as particles in admixture with catalytic cracking catalyst particles in the circulating catalyst inventory.

10 Claims, 3 Drawing Sheets

COMPOSITIONS FOR USE IN CATALYTIC CRACKING TO MAKE REDUCED SULFUR CONTENT GASOLINE

BACKGROUND OF THE INVENTION

In the production of gasoline, the desire to produce a clean product is constantly present. This desire comes both from increased environmental awareness and regulation and from a general desire to maximize product performance. In many hydrocarbon feedstocks commonly used to make gasoline via catalytic cracking, sulfur is present as an undesirable impurity.

In conventional fluidized catalytic cracking (FCC) operations, a portion of the sulfur may be removed via formation of $H_2S$ during the cracking operation or by formation of sulfur-containing coke on the cracking catalyst particles. Unfortunately, the gasoline resulting from such FCC processes typically will still contain a significant amount of sulfur from the original feedstock.

Currently, if it is desired to reduce the sulfur content of the output gasoline, some additional treatment step has typically been necessary. For example, the feedstock may be treated before cracking in a separate step involving the use of Mn-containing compositions (U.S. Pat. No. 2,618,586), Cu on inorganic oxide (U.S. Pat. No. 4,204,947), titania on clay (U.S. Pat. No. 4,549,958) or other substances. Alternatively, the sulfur content of output gasoline has been reduced via hydrotreatment of the feedstock. These known measures typically increase the refining cost both from the need for added equipment to perform the additional process steps and from the need to use additional materials in the refining process.

Recently, certain compositions have been developed which can be used directly in an FCC operation (i.e., in the circulating catalyst inventory) to reduce the sulfur content of the resulting gasoline without use of additional process steps or the use of added hydrogen. Such compositions, disclosed in U.S. Pat. No. 5,376,608, comprise an alumina-supported Lewis acid component. The disclosure of U.S. Pat. No. 5,376,608 is incorporated herein by reference.

While the compositions of U.S. Pat. No. 5,376,608 are effective, there is a desire to obtain an even greater degree of reduction in the output gasoline sulfur level from FCC processes without use of additional process steps or the use of added hydrogen.

SUMMARY OF THE INVENTION

New compositions which contain a titania component have been found which provide further reduction of sulfur levels in the gasoline resulting from FCC processes (and other cracking processes conducted in the absence of added hydrogen) without the need for feedstock pretreatments nor added hydrogen. The invention further encompasses catalytic cracking processes using the compositions of the invention which result in reduced levels of sulfur in the resulting gasoline without the need for feedstock pretreatments nor added hydrogen.

In one aspect, the invention encompasses a cracking catalyst composition comprising an admixture of (a) cracking catalyst particles adapted to catalyze the cracking of a hydrocarbon feedstock and (b) titania-containing particles having less activity for catalytic cracking compared to the cracking catalyst particles.

In another aspect, the invention encompasses a composition suitable for use in hydrocarbon cracking processes, the composition comprising:

a) a first component containing titania, and b) a second component containing a Lewis acid selected from the group comprising elements and compounds of Ni, Cu, Zn, Ag, Cd, In, Sn, Hg, Tl, Pb, Bi, B, Al (other than $Al_2O_3$) and Ga supported on alumina.

The invention also encompasses a cracking catalyst composition comprising cracking catalyst particles adapted to catalyze the cracking of a hydrocarbon feedstock in combination with components (a) and (b).

In a further aspect, the invention encompasses a process for catalytic cracking a hydrocarbon feedstock wherein the feedstock is cracked in a cracking zone in the absence of added hydrogen and an inventory of particles, including catalyst particles, is repeatedly circulated between a hydrocarbon cracking zone and a catalyst regeneration zone, wherein the improvement comprises the inventory containing additional particles, which additional particles: (a) have less activity for cracking hydrocarbons compared to the catalyst particles, (b) contain titania, and (c) can be circulated as independent particles under the operating conditions of the process.

In another aspect, the invention encompasses a process for catalytic cracking a hydrocarbon feedstock wherein said feedstock is cracked in a cracking zone in the absence of added hydrogen, and an inventory of particles, including catalyst particles, is repeatedly circulated between a hydrocarbon cracking zone and a catalyst regeneration zone, wherein the improvement comprises the circulated inventory further containing:

a) a first component containing titania, and b) a second component containing a Lewis acid selected from the group comprising elements and compounds of Ni, Cu, Zn, Ag, Cd, In, Sn, Hg, Tl, Pb, Bi, B, Al (other than $Al_2O_3$) and Ga supported on alumina.

The invention is especially applicable in the context of fluidized catalytic cracking of hydrocarbon feedstocks to produce gasoline. These and other aspects of the invention are described in further detail below.

DETAILED DESCRIPTION OF THE INVENTION

Figure 1:
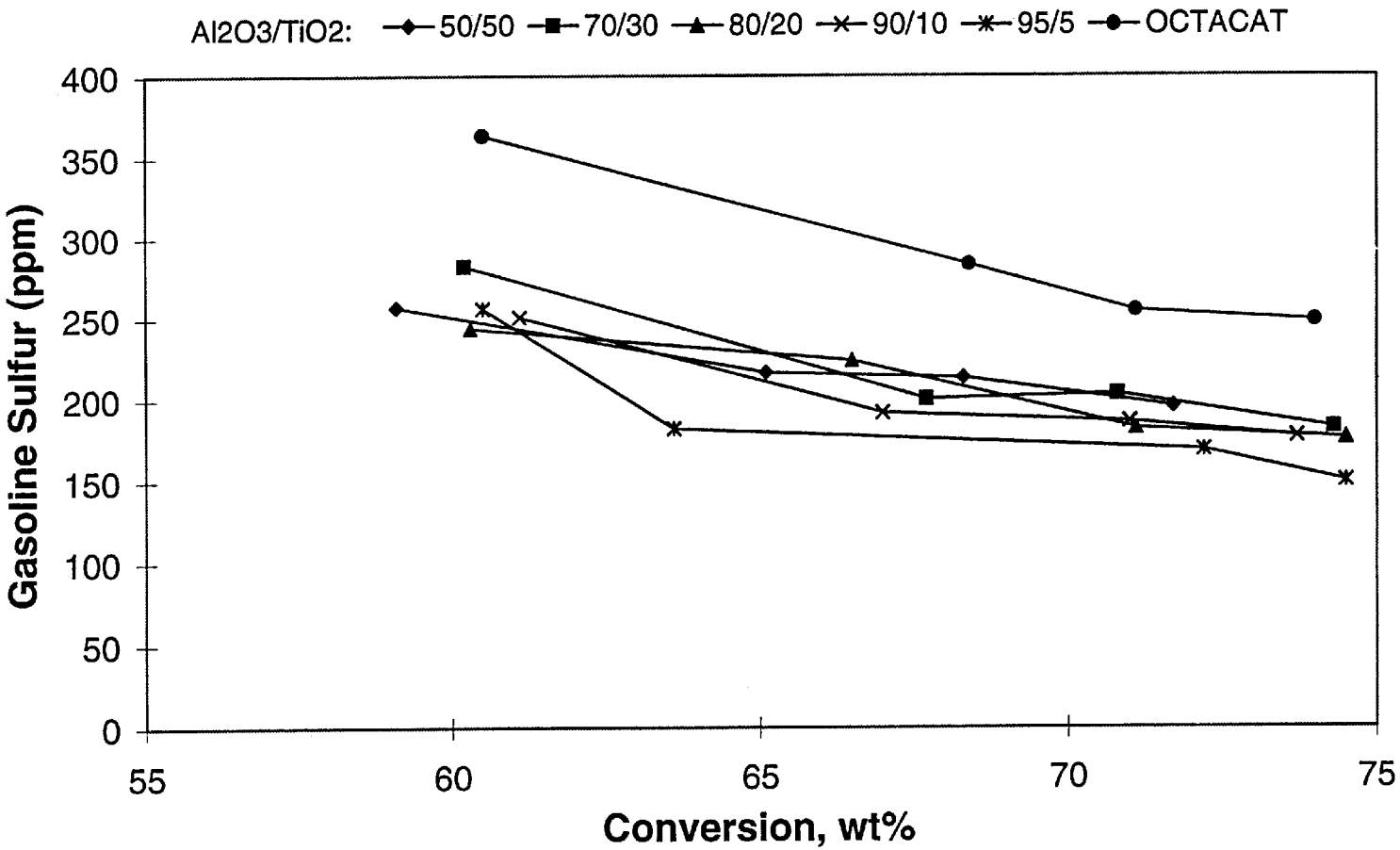
FIG. 1 is a plot of cut gasoline sulfur vs. % conversion for admixture of cracking catalyst with various titania-alumina coprecipitates.

The invention centers on the discovery that certain $TiO_2$-containing components lower S level in the gasoline output from cracking operation and that those $TiO_2$-containing components when combined with alumina-supported Lewis acid components act in a complementary manner to provide improved reduction of sulfur level in gasoline output from catalytic cracking processes, especially FCC processes.

The $TiO_2$-containing component is most preferably one which is capable of maintaining some level of $TiO_2$ surface area during the course of use in a catalytic cracking process, (especially in a fluidized catalytic cracking process involving cracking, stripping, regeneration). The majority, if not substantially all, of the titania is preferably in the anatase crystal form. If desired, the $TiO_2$-containing component may contain a $TiO_2$ precursor. In such instances, the precursor is preferably one which forms titania on use in the catalytic cracking process and/or by calcination. Examples of suitable precursors include compounds such as titanyl sulfate, titanium ethoxide, titanium sulfate, titanic acid, titanium oxalate, and titanium tetrachloride. The $TiO_2$-containing component preferably has a surface area of at least 10 $m^2/g$, more preferably at least about 30 $m^2/g$. In its fresh state (prior to introduction into the catalyst inventory), the $TiO_2$-containing component may have a surface area as much as 150 $m^2/g$ or more.

Preferably, the $TiO_2$-containing component contains an additional inorganic oxide(s) (i.e., other than titania) to improve the surface area stability of the titania. The inorganic oxide for this purpose is preferably selected from the group consisting of silica, alumina, silica-alumina, zirconia, niobium oxide, and mixtures thereof. In general, alumina is the most preferred stabilizing oxide. Preferably, the $TiO_2$-containing component does not contain appreciable amounts of Group VI or Group VIII transition metals such as typically found in hydrotreating compositions.

The $TiO_2$-containing component preferably contains at least 5 wt. % $TiO_2$ or $TiO_2$ precursor (measured as $TiO_2$), more preferably at least about 10 wt. %. The $TiO_2$-containing component preferably contains at least 3 wt. % of stabilizing inorganic oxide, more preferably at least about 30 wt. %, most preferably at least about 50 wt. %. Preferably, the $TiO_2$-containing component preferably consists essentially of $TiO_2$ or $TiO_2$ precursor (measured as $TiO_2$) and stabilizing oxide(s).

In cases where the $TiO_2$-containing component is formed by coprecipitation, the mole ratio of $TiO_2$ to total stabilizing oxide is preferably 5-95:5-95, more preferably about 1:1. In cases where the $TiO_2$-containing component is formed by impregnation of stabilizing oxide particles, the amount of $TiO_2$ is preferably at least about 5 wt. %, more preferably about 10–20 wt. % based on the initial weight of the inorganic oxide particles. In cases where the $TiO_2$-containing component is formed by compositing titania particles with a reactive alumina, the amount of $TiO_2$ is preferably about 10–40 wt. %, more preferably about 15–30 wt. %.

The titania-containing component is preferably further characterized by a surface titania concentration of at least about 5 mole %, more preferably at least about 15 mole %, most preferably at least 20 mole % as measured by XPS (X-ray photoelectron spectroscopy). The XPS test was carried out with a model PH15600 spectrometer (Physical Electronics, Inc.) using monchromated Al K$\alpha$(1486.6 eV) radiation at 300 W of power. The sample powder was deposited on a double-sided adhesive tape which was then fixed to a sample block. Charging neutralization was achieved with an electron flood gun. The binding energy analysis was referenced to the C1s of the adventitious hydrocarbon. Quantitative analysis was performed by analyzing XPS peak areas using atomic sensitivity factors provided by Physical Electronics, Inc. The above test conditions generally characterize the surface layer to a 20–25Å depth.

Where the titania-containing component is used in combination with a component containing an alumina-supported Lewis acid, the alumina-supported Lewis acid is preferably one such as described in U.S. Pat. No. 5,376,608. Thus, the alumina-supported Lewis acid component preferably contains a Lewis acid selected from the group comprising elements and compounds of Ni, Cu, Zn, Ag, Cd, In, Sn, Hg, Tl, Pb, Bi, B, Al (other than $Al_2O_3$) and Ga supported on alumina. Most preferably, the Lewis acid contains Zn.

The cracking catalyst particles which may be used in conjunction with the titania-containing component of the invention (or combination thereof with the alumina-supported Lewis acid component), may be of any conventional FCC catalyst composition. Thus, the cracking catalyst particles preferably contain at least one cracking catalyst component which is catalytically active for the cracking of hydrocarbons in the absence of added hydrogen. The cracking catalyst component preferably comprises a zeolite, a non-zeolite molecular sieve, a catalytically active amorphous silica alumina species, or a combination thereof. The cracking catalyst component is preferably a zeolite selected from the group consisting of X, Y, USY, REY, CREY, ZSM-5, Beta, and mixtures thereof. The cracking catalyst particles may also contain one or more matrix components such as clays, modified clays, alumina, etc. The cracking catalyst particles may also contain a binder such as an inorganic oxide sol or gel. Preferably, the cracking catalyst particles contain at least 5 wt. %, more preferably about 5 to 50 wt. %, of cracking catalyst component.

Where the titania-containing component is used (without the alumina-supported Lewis acid component) in combination with the cracking catalyst particles, the amount of titania-containing component is preferably at least about 1 wt. %, more preferably about 1 to 30 wt. %, most preferably about 5 to 15 wt. % based on the total weight of said circulated particle inventory in the FCC unit. In this embodiment, the titania-containing component is preferably used in the form of separate admixture particles (titania component particles) which preferably have suitable particle size and attrition resistance for use in an FCC process. The titania component particles are preferably capable of flowing independently from the cracking catalyst particles (i.e. without becoming attached to the cracking catalyst particles) as part of the cracking catalyst inventory. The particle size in this instance is preferably about 20–150 $\mu$m, and the Davison attrition index is preferably less than 20, more preferably less than 10. The titania component particles preferably possess significantly less catalytic cracking activity (e.g. preferably, at least an order of magnitude lower activity for cracking hexane) in comparison with the fresh cracking catalyst particles (either as spray dried or as calcined).

Where the titania-containing component and the alumina-supported Lewis acid component are used in combination, the performance of the components with respect to reduction of gasoline sulfur levels has been surprisingly found to be complementary, such that the use of a combination of these components generally results in improved reduction of sulfur levels compared to the use of either component alone. The amount of alumina-supported Lewis acid component used in combination with the titania-containing component may be varied significantly, as may be desired to optimize the outcome of the overall cracking process for a given set of conditions. The components are preferably present in a weight ratio of about 1:10 to 10:1 (titania-containing component:alumina-supported Lewis acid), more preferably in a ratio of about 3:7 to 7:3, most preferably about 1:1. The combination of the titania-containing component and the alumina-supported Lewis acid component preferably forms at least 1 wt. % of the circulating particle inventory in the cracking process, more preferably about 1 to 30 wt. %, most preferably about 5 to 15 wt. %.

The combination of the titania-containing component and the alumina-supported Lewis acid component may be used in a variety of forms such as: (i) integrated component particles wherein individual particles contain both components, (ii) an admixture of distinct component particles wherein individual particles contain either component, but not both components, (iii) integrated catalyst particles wherein individual particles contain cracking catalyst component and both components of the combination, (iv) integrated catalyst particles wherein individual particles contain cracking catalyst component and one component of the combination with the other component of the combination being in the form of an admixture particle, or (v) a combination of variations (i)–(iv) above. Preferably, the combination is used in the form of variation (ii) since it provides the greatest freedom to adjust the relative proportions of the titania-containing component and the alumina-supported Lewis acid component for a specific cracking process independent of the cracking catalyst component.

In the above variations, all the particles preferably have suitable particle size and attrition resistance for use in an FCC process. The component particles (present in variations (i), (ii) and (iv) above) are preferably capable of flowing independently from the cracking catalyst particles (i.e. without becoming attached to the cracking catalyst particles) as part of the cracking catalyst inventory. The particle are preferably about 20–150 $\mu$m in size with a Davison attrition index is preferably less than 20, more preferably less than 10. The component particles (i.e., those not containing a cracking catalyst component) preferably possess significantly less catalytic cracking activity (for cracking hexane) in comparison with the fresh cracking catalyst particles.

The titania-containing component of the invention may be formed by any suitable technique as long as the desired stabilized surface area is achieved. Preferably, the $TiO_2$-containing component is formed by coprecipitation, sequential precipitation, impregnation, or compositing (with or without a binder).

Techniques for coprecipitation of titania with other oxides are known in the art. For example, see U.S. Pat. Nos. 4,465,790; 3,401,125 and 3,016,346. Coprecipitation techniques generally involve addition of a titania precursor compound to a solution (preferably aqueous) of a precursor of the other desired oxide(s) (e.g., alumina, silica, etc.). Examples of suitable titania precursors include compounds such as titanyl sulfate, titanium ethoxide, titanium sulfate, titanic acid, and titanium tetrachloride with titanyl sulphate being most preferred. Preferred silica and alumina precursors are sodium silicate and sodium aluminate, respectively. Preferably, the pH of the resulting solution is maintained at neutral to basic level, (e.g., about 6–9, more preferably about 8–9) and agitation is used during combination of the precursors and during the precipitation. After the precipitation has occurred, the precipitate is preferably recovered and washed to remove undesired ions (typically sulfate). The precipitate is then preferably spray dried at about 100–140° C. The resulting particles are then preferably washed to remove sodium ions. If desired, the compositions may be calcined. Calcining conditions (e.g. 15 min.–2 hr. @ 400–800° C.) are preferably selected to avoid the conversion of the titania from anatase to rutile crystal structure.

The $TiO_2$-containing component may also be formed by impregnation techniques such as those described in U.S. Pat. No. 4,705,770, the disclosure of which is incorporated herein by reference. Impregnation techniques generally involve selection of particles of a desired inorganic oxide and impregnation of those particles with a solution of titania precursor (preferably titanyl sulfate). The impregnated particles are then preferably calcined to convert the titania precursor to titania, washed to remove residual salts, and spray dried.

The titania-containing component may also be formed by compositing titania particles with stabilizing inorganic oxide particles. Preferably, the particles of titania and stabilizing inorganic oxide are of a size suitable for peptization with an acid such as HCl or formic acid. Preferably, the titania particles and stabilizing inorganic oxide particles are combined to form an aqueous slurry. An acid such as HCl or formic acid (or other known peptizing acid) is preferably added to the slurry. Alternatively, the stabilizing oxide particles may be peptized before addition of the titania particles. The peptized slurry is then spray dried to form the titania component. The titania particles preferably have a surface area of about 150 $m^2/g$ or more. The particle size of the stabilizing oxide is preferably one which is conducive to peptization. A preferred titania for this method is UNITANE® 908 sold by Kemira, Inc. of Savanah, Ga. and a preferred stabilizing oxide is Versal® 700 reactive alumina sold by LaRoche Chemical Co.

Where the titania-containing component is to be used as an admixture particle, the desired particle size and attrition index can generally be achieved by conventional spray drying and/or calcination techniques. If necessary, a binder, such as an inorganic sol binder, may be added prior to admixture particle formation to facilitate particle formation and/or binding. A peptizing agent (e.g. HCl or formic acid) may also be added before admixture particle formation to facilitate particle formation and/or binding.

The inorganic oxide particles to be impregnated preferably have a surface area of at least 50 $m^2/g$, more preferably at least 100 $m^2/g$. Where the titania-containing component is to be used as a separate admixture particle, the inorganic oxide particles to be impregnated preferably already possess the particle size and attrition index of the desired admixture particles.

If desired, the resulting titania-containing component may be calcined in steam to decrease any tendency to form coke in the cracking process. In such case, the steaming is preferably conducted at about 500 to 800° C. for about 0.25 to 24 hours.

The alumina-supported Lewis acid component may be prepared by the techniques described in U.S. Pat. No 5,376,608, the disclosure of which is incorporated herein by reference.

Techniques for forming integral particles of are known in the art. For example, see U.S. Pat. Nos. 3,957,689; 4,499,197; 4,541,118 and 4,458,023, the disclosures of which are incorporated herein by reference. Where an integral particle of the titania-containing component and the alumina-supported Lewis acid component is desired, this is preferably accomplished by spray drying an aqueous slurry of the two components, optionally with a binder such as an alumina sol.

The compositions of the invention may be used in any conventional FCC process or other catalytic cracking processes characterized by the absence of added hydrogen. The compositions of the invention may be added to the circulating catalyst particle inventory of cracking process at start-up and/or during the course of the cracking process. The compositions of the invention may be added directly to the cracking zone, to the regeneration zone of the cracking apparatus or at any other suitable point for achieving the desired reduction in sulfur level. Typical FCC processes are conducted at reaction temperatures of about 400 to 650° C. with catalyst regeneration temperatures of about 600 to 850° C. The compositions of the invention may be used in FCC processing of any typical hydrocarbon feedstock. Preferably, the compositions of the invention are used in FCC processes involving the cracking of hydrocarbon feedstocks which contain about 0.2–3.5 wt. % sulfur, more preferably about 0.3–1.5 wt. % sulfur.

The invention is further illustrated by the following examples. It should be understood that the invention is not limited to the details of the examples.

EXAMPLE 1

Preparation of Titania-alumina Coprecipitates

Titania-alumina coprecipitates were prepared by combining aqueous solutions of sodium aluminate (22 wt. % $Al_2O_3$) and titanyl sulfate (9.5 wt. % $TiO_2$) to achieve the desired $TiO_2$:$Al_2O_3$ mole ratio. Deionized water is also added to achieve a solids content of about 12 wt. %. The pH of the mixture was adjusted to about 8.5 by addition of ammonium hydroxide. The mixture was then allowed to age overnight. The resulting coprecipitate was then filtered and washed with dilute ammonium hydroxide to reduce the sulfate content of the coprecipitate to less than about 1 wt. %. The washed coprecipitate was then dried, pressed and screened to recover particles between 40 and 80 Mesh. The particles were then calcined at about 700° C. for about 3 hours.

EXAMPLE 2

Preparation of Supported Titania

Supported titania compositions were prepared by impregnating samples of either alumina particles (Grace Davison SRA alumina) or silica alumina particles (Grace Davison SRS-II silica alumina) with a titanium ethoxide/ethanol solution to achieve the desired titania level. The impregnated particles were then dried and calcined at 700° C. for about 3 hours.

EXAMPLE 3

Preparation of Titania-alumina Particle Composites

Composited titania-alumina compositions were prepared by combining the desired amount of titania particles (Kemira Unitane® 908) and reactive alumina particles (Versal® 700) with deionized water to achieve an alumina concentration (in the resulting slurry) of about 15 wt. %. About 0.25 moles HCI was added to the slurry per mole of alumina in order to peptize the alumina. The resulting mixture was aged for about 1 hour followed by milling and spray drying.

EXAMPLE 4

Comparison of Coprecipitate $TiO_2$:$Al_2O_3$ Mole Ratios

Samples of titania-alumina coprecipitates were prepared according to the procedure of Example 1 at the following $Al_2O_3$:$TiO_2$ mole ratios: 50:50, 70:30, 80:20, 90:10, 95:5. The samples were steamed at 1400° F. (760° C.). Each sample of coprecipitate particles was then admixed with commercial cracking catalyst particles (Grace Davison Octacat®) in a ratio of 10 wt. % coprecipitate to 90 wt. % cracking catalyst.

The admixtures were then used to crack a gas oil A (1 wt. % S) in a microactivity (MAT) test as set forth in ASTM 3907. A sample containing 100% Octacat® cracking catalyst was also tested as a control. The sulfur content of the output was then measured as a function of wt. % conversion in the MAT test which was varied for each sample across a range of about 60–75% conversion. The sulfur content in the output gasoline is show in FIG. 1 for cut gasoline sulfur where the cut includes the gasoline fraction having a boiling point below 430° F. (221° C.)—the boiling point of benzothiophene. The data in FIG. 1 shows that the titania-alumina coprecipitates result in a significant decrease in gasoline sulfur across a range of mole ratios and conversion rates.

EXAMPLE 5

Comparison of Titania-impregnated Oxide and Coprecipitated Titania

Samples of titania-impregnated oxides were prepared according to example 2 for alumina (Grace Davison SRA), and silica alumina (Grace Davison SRS II) to a 12 wt. % $TiO_2$ level. An additional coprecipitate was prepared according to example 1, except that sodium silicate was used instead of sodium aluminate to achieve an $SiO_2$ to $TiO_2$ ratio of 95:5. These compositions steamed for 4 hours at 1400° F. (760° C.). Each sample of titania-containing particles was then admixed with commercial cracking catalyst particles (Grace Davison Octacat) at a 10 wt. % level relative to the total weight of the admixture.

Figure 2:
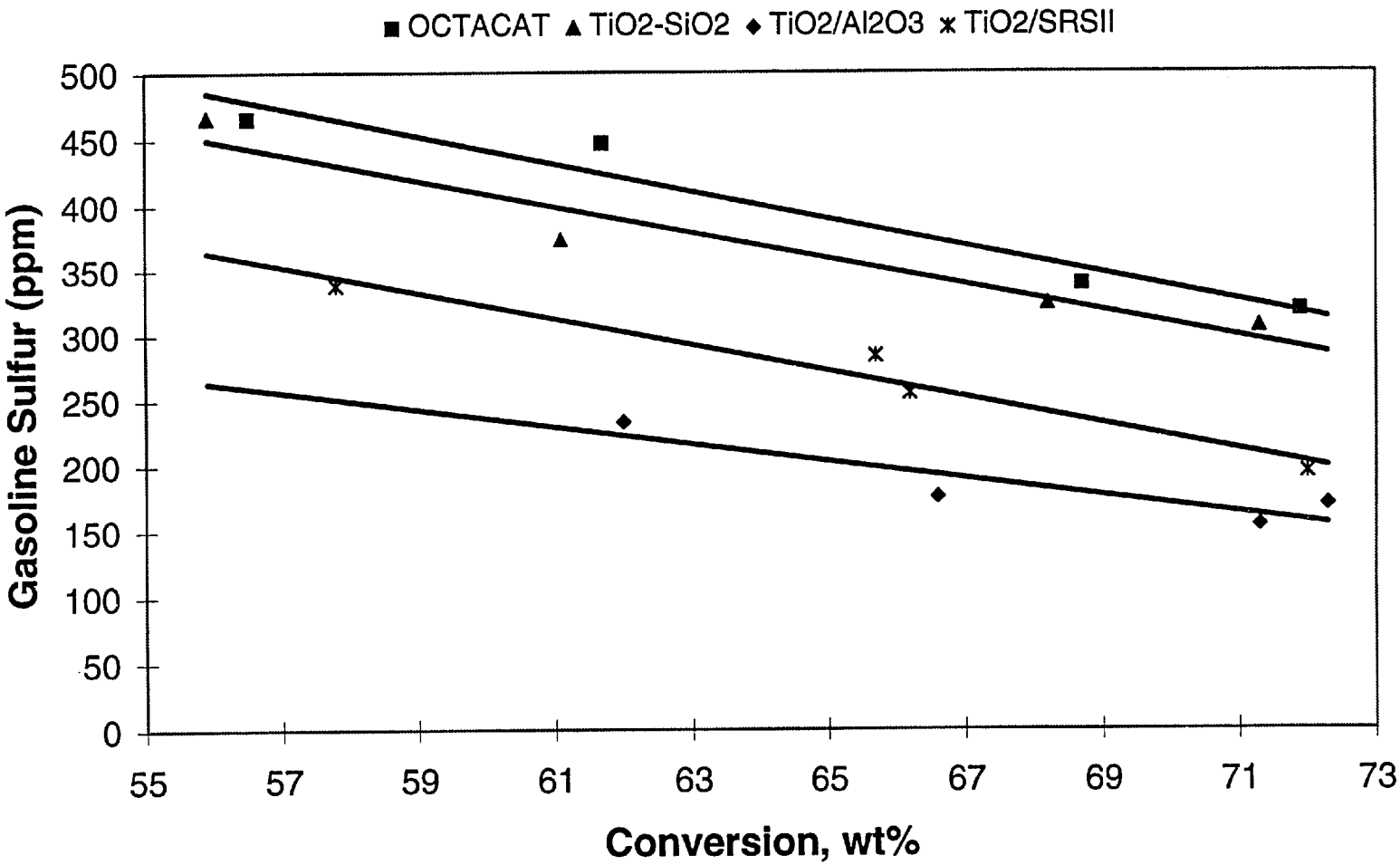
FIG. 2 is a plot of cut gasoline sulfur vs. % conversion for admixture of cracking catalyst with various titania-impregnated materials and titania-containing coprecipitates.

The admixtures were then used to crack a gas oil A (1 wt. % S) in a microactivity (MAT) test as set forth in ASTM 3907. The sulfur content of the output was then measured as a function of wt. % conversion in the MAT test which was varied for each sample across a range of about 55–75% conversion. The sulfur content in the output gasoline is show in FIG. 2 for cut gasoline sulfur (B.P. <430° F.). From the FIG. 2, it can be seen that all the titania-containing components tested showed a reduction in gasoline sulfur compared to the base catalyst.

EXAMPLE 6

Combination of Titania-containing Component With Alumina-supported Lewis Acid

An alumina-supported Lewis acid (Zn) was prepared in accordance with U.S. Pat. 5,376,608. A portion of the alumina-supported Lewis acid and/or a 50:50 titania-alumina coprecipitate (prepared according to example 1) was admixed with Octacat® cracking catalyst to produce the following samples: (a) 10 wt. % alumina-supported Lewis acid and 90 wt. % Octacat® cracking catalyst, (b) 10 wt. % titania-alumina coprecipitate and 90 wt. % Octacat® cracking catalyst, (c) 5 wt. % alumina-supported Lewis acid, 5 wt. % titania-alumina coprecipitate, and 90 wt. % Octacat® cracking catalyst, and (d) 100% Octacat® cracking catalyst. These samples were each steamed for 4 hours at 1400° F.

Figure 3:
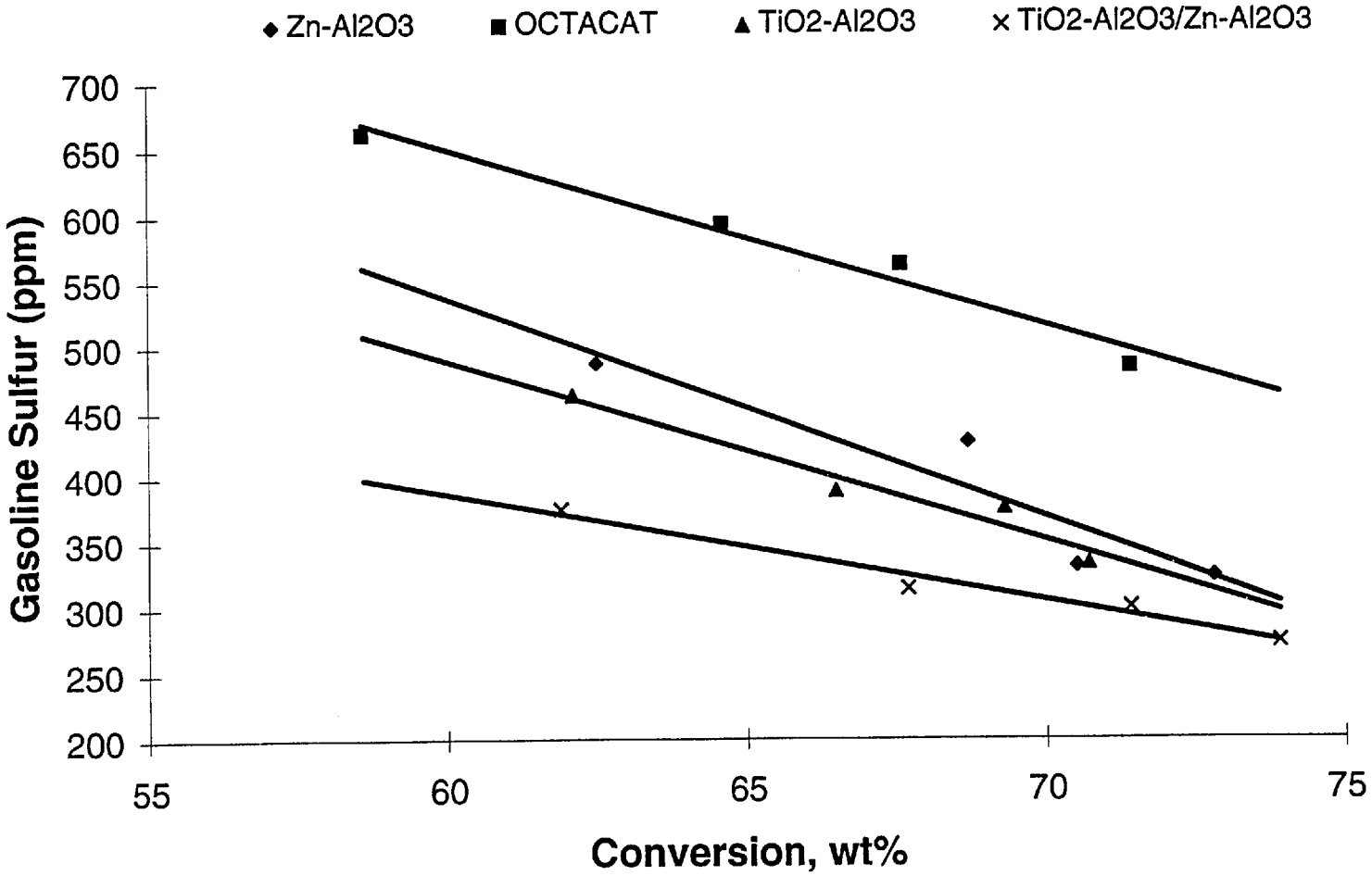
FIG. 3 is a plot of cut gasoline sulfur vs. % conversion for admixture of cracking catalyst with titania-alumina coprecipitate and/or alumina-supported Lewis acid.

The samples were then used to crack gas oil B (2.7 wt. % S) in a microactivity (MAT) test as set forth in ASTM 3907. The sulfur content of the output was then measured as a function of wt. % conversion in the MAT test which was varied for each sample across a range of about 55–75% conversion. The sulfur content in the output gasoline is show in FIG. 3 for cut gasoline sulfur. The results in FIG. 3 indicate that the combination of the alumina-supported Lewis acid component and the titania-containing component results in greater sulfur reduction that than use of the same total amount of either component alone.

EXAMPLE 7

Titania-alumina Particle Composite & Combination With Alumina-supported Lewis Acid A titania-alumina particle composite was prepared according to example 3 using 80 wt. % alumina (Versal® 700) and 20 wt. % titania. The composite particles had a Davison attrition index of 3, a surface area of about 200 $m^2/g$ (Nitrogen BET), and an average bulk density of 0.80. The composite particles and particles of the alumina-supported Lewis acid of Example 6 were separately steamed for 24 hours @ 1350° F. (732° C.). A commercial cracking catalyst (Grace Davison Super Nova-D®) was separately steamed for four hours at 1500° F. (816° C.). Samples were prepared as follows: (a) admixture of 10 wt. % of the alumina-supported Lewis acid with 90% of the commercial cracking catalyst, (b) admixture of 5 wt. % of the titania-alumina particle composite, 5 wt. % of the alumina-supported Lewis acid with 90% of the commercial cracking catalyst, and (c) 100% cracking catalyst (Grace Davison Super Nova-D®).

Each sample was used to crack gas oil A (1 wt. % S) in a microactivity (MAT) test as set forth in ASTM 3907. The sulfur content of the output was then measured as a function of wt. % conversion in the MAT test at 70% and 72% conversion. The sulfur content in the output gasoline is show in Table 1 for cut gasoline sulfur. The results in Table 1 indicate that the combination of the and the titania-containing component results in greater sulfur reduction that than use of the same total amount of the alumina-supported Lewis acid component alone.

TABLE 1

| Sample | Conversion | Cut Gasoline Sulfur (ppm) | Total Gasoline Sulfur (ppm) |
|---|---|---|---|
| (a) Supptd Lewis Acid + cracking catalyst | 70% | 333.50 | 593.40 |
| (b) Ti compnt + Supptd Lewis Acid + cracking catalyst | 70% | 264.55 | 510.80 |
| (c) cracking catalyst | 70% | 495.23 | 760.86 |
| (a) | 72% | 315.90 | 586.67 |
| (b) | 72% | 241.95 | 503.76 |
| (c) | 72% | 480.83 | 766.88 |

What is claimed is:

1. A process for fluidized catalytic cracking a hydrocarbon feedstock comprising sulfur wherein (i) said feedstock is cracked in a cracking zone in the absence of added hydrogen, and (ii) an inventory of particles, including catalyst particles, is repeatedly circulated between a hydrocarbon cracking zone and a catalyst regeneration zone, wherein said inventory comprises additional particles which: (a) have less activity for catalyzing the cracking of hydrocarbons compared to said catalyst particles, said activity being on a fresh particle basis, (b) consists essentially of titania and inorganic oxide other than titania, and (c) are independently fluidizable under the operating conditions of said process.

2. The process of claim 1 wherein said inorganic oxide is selected from the group consisting of silica, alumina, silica-alumina, zirconia, niobium oxide and mixtures thereof.

3. The process of claim 1 wherein said additional particles comprise a coprecipitate of $TiO_2$ and said inorganic oxide(s).

4. The process of claim 2 wherein said inorganic oxide comprises alumina.

5. The process of claim 4 wherein said $TiO_2$ and said $Al_2O_3$ are present in a molar ratio of 5-95:5-95.

6. The process of claim 1 wherein said additional particles have a particle size of about 20–150 $\mu$m.

7. The process of claim 1 wherein said additional particles contain at least 5 wt. % $TiO_2$.

8. The process of claim 7 wherein said additional particles contain about 10 to 50 wt. % $TiO_2$.

9. The process of claim 1 wherein said additional particles are present in an amount of about 1 to 30 wt. % based on the total weight of said circulated inventory.

10. The process of claim 1 wherein said feedstock has a sulfur content of at least about 0.2 wt. %.

* * * * *